US009833915B2

(12) United States Patent
Burghardt et al.

(10) Patent No.: US 9,833,915 B2
(45) Date of Patent: Dec. 5, 2017

(54) MALE DRY SHAVER

(71) Applicant: Braun GmbH (a German Corporation), Kronberg (DE)

(72) Inventors: Renata Burghardt, Kronberg (DE); Gerd Laschinski, Oberursel (DE); Jan Christian Langsdorf, Oberursel (DE); Diana Kappes, Eppstein (DE); Sonja Georgescu, Frankfurt (DE)

(73) Assignee: Braun GmbH, Kronberg (DE)

( * ) Notice: Subject to any disclaimer, the term of this patent is extended or adjusted under 35 U.S.C. 154(b) by 232 days.

(21) Appl. No.: 14/220,204

(22) Filed: Mar. 20, 2014

(65) Prior Publication Data

US 2014/0290452 A1 Oct. 2, 2014

(30) Foreign Application Priority Data

Mar. 27, 2013 (EP) ..... 13001597

(51) Int. Cl.
*B26B 19/38* (2006.01)

(52) U.S. Cl.
CPC ..... *B26B 19/3873* (2013.01); *B26B 19/382* (2013.01); *B26B 19/388* (2013.01); *Y10T 83/041* (2015.04)

(58) Field of Classification Search
CPC ... B26B 19/38; B26B 19/3806; B26B 19/382; B26B 19/3873; B26B 19/388; Y10T 83/041
See application file for complete search history.

(56) References Cited

U.S. PATENT DOCUMENTS

| | | | | |
|---|---|---|---|---|
| 3,141,239 | A * | 7/1964 | Meyer | B26B 19/40 30/34.05 |
| 3,364,568 | A * | 1/1968 | Lowy | B26B 19/40 219/531 |
| 6,825,445 | B2 | 11/2004 | Shalev et al. | |
| 2009/0049694 | A1 | 2/2009 | Morris | |
| 2011/0099814 | A1 | 5/2011 | Fuerst et al. | |

FOREIGN PATENT DOCUMENTS

| | | |
|---|---|---|
| DE | 10147286 | 5/2003 |
| GB | 979183 | 1/1965 |
| JP | A-S61-20109 | 1/1986 |
| JP | A-S61-240988 | 10/1986 |
| WO | WO-2012123923 A1 * | 9/2012 |

OTHER PUBLICATIONS

European Search Report dated Aug. 5, 2013, 4 pages.

* cited by examiner

*Primary Examiner* — Stephen Choi
(74) *Attorney, Agent, or Firm* — Ronald T. Sia; Kevin C. Johnson; Steven W. Miller

(57) ABSTRACT

An electrically driven shaver comprises a housing and at least one hair cutting element that is driven by an electromotor. A thermoelectric skin cooling element and the electromotor are electrically operable by a microcontroller and an on/off switch which is electrically connected with the microcontroller. The microcontroller is adapted to activate and deactivate operation of both the electromotor and the skin cooling element. The skin cooling element is located adjacent to the hair cutting element. The microcontroller is adapted to immediately deactivate operation of the electromotor and relative to that to deactivate operation of the skin cooling element at later point of time, both in response to the "off" actuation of the same on/off switch.

11 Claims, 1 Drawing Sheet

MALE DRY SHAVER

FIELD OF THE INVENTION

There is provided an electrically driven shaver, comprising a housing, at least one hair cutting element that is driven by an electromotor, a thermoelectric skin cooling element and said electromotor are electrically operable by a microcontroller and an on/off switch which is electrically connected with said microcontroller, wherein said microcontroller is adapted to activate and deactivate operation of both the electromotor and the skin cooling element and wherein said skin cooling element is located adjacent to the hair cutting element. There is further provided a method for operating such a shaver and a use of such a shaver.

BACKGROUND OF THE INVENTION

From WO-A1-2010003603 an electrically driven shaver with a skin cooling element is known as set forth with the features of the preamble portion of claim 1. Sometimes skin irritations are caused by dry shavers as the friction between relative to each other moving hair cutter portions result in its warming up. Thus a cooling element within the cutting arrangement which is in contact with the skin that has just been shaved helps to keep the skin cooled and avoids skin irritations caused by warming up of the shaved skin. It has been found however that depending from the usage of the shaver that interrupted or repeatedly intermitted shaver usage does not always assure that the skin cooling element provides sufficient cooling effect.

SUMMARY OF THE INVENTION

Thus it is an object of the invention to provide an electrically driven shaver with skin cooling element comprising the features of the preamble portion of claim 1 that helps avoiding skin irritations independent from the usage behavior of the user. It is further an object to provide a method of operation and a use of such a shaver.

These objects are addressed by the features of claim 1, with respect to the shaver, by the features of claim 12, with respect to the method and by the features of claim 15 with respect to the use. The features as set forth with the sub claims provide advantageous further additions to that.

In accordance with one aspect, there is provided a delayed switch off of the skin cooling element relative to the switch off of the electromotor that drives the hair cutting elements. Thus the skin cooling element is operated with an after cooling during a time interval. This provides two advantageous. Firstly, in case the user actuates the off switch, e.g. just to check the status of his shaving and wants to continue shaving after a short interruption the skin cooling element is still cooled and will be immediately again effective to avoid skin irritations. Secondly, in case the skin cooling element comprises a peltier element the usually cold side thereof gets warm after same is completely switched off. Thus further operating the skin cooling element after switch off of the shaver operation avoids that the skin cooling element gets warm at the free end skin contact section. Therefore the portion of the skin cooling element which is provided to be cool keeps being cool after switch off.

In accordance with a further aspect, there is provided a reduced operation of the peltier element after the shaver is switched off. This keeps in balance that the energy consumption of the thermocouple/peltier element is kept low by just avoiding that the cold side of same is getting warm by complete switch off.

Both above aspects may be alternatives or combined with each other.

BRIEF DESCRIPTION OF DRAWINGS

These and other features will become apparent not only from the claims but also from the following description and the drawings, with the aid of which example embodiments are explained below.

FIG. 1 shows a schematic cross sectional view of the shaver according to the present disclosure and FIG. 2 shows a time/temperature diagram of the heat sink and the free end skin contact portion during shaving operation and after that.

DETAILED DESCRIPTION OF THE INVENTION

Figure 1:
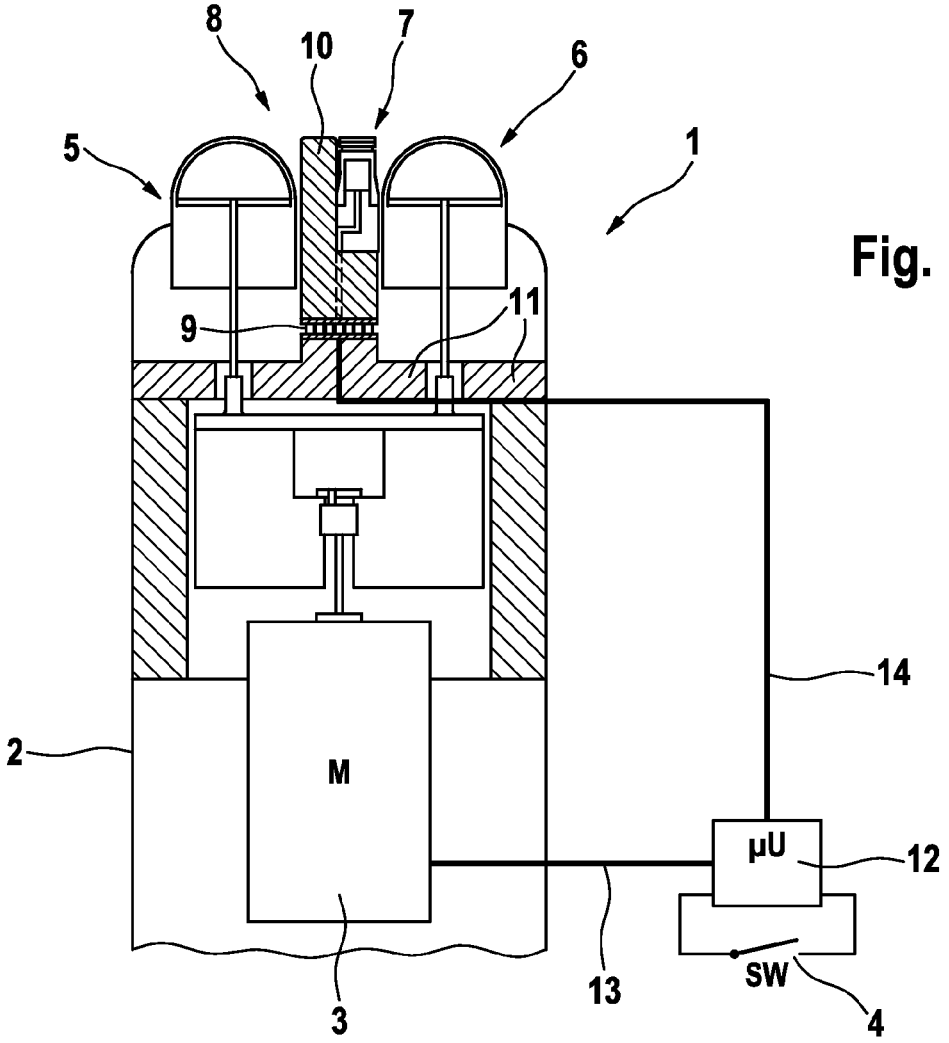

The following is a description of numerous versions of an electrically driven shaver with a skin cooling element. The description further discloses a method of operation of such a shaver and the use thereof. The description is to be construed as exemplary only and does not describe every possible embodiment since describing every possible embodiment would be impractical, if not impossible, and it will be understood that any feature, characteristic, structure, component, step or methodology described herein can be deleted, combined with or substituted for, in whole or in part, any other feature, characteristic, structure, component, product step or methodology described herein.

According to one aspect there is provided a an electrically driven shaver, comprising a housing, at least one hair cutting element that is driven by an electromotor, a thermoelectric skin cooling element and said electromotor are electrically operable by a microcontroller and an on/off switch which is electrically connected with said microcontroller, wherein said microcontroller is adapted to activate and deactivate operation of both the electromotor and the skin cooling element and wherein said skin cooling element is located adjacent to the hair cutting element characterized in that said microcontroller is adapted to immediately deactivate operation of said electromotor and relative to that to deactivate operation of said skin cooling element at later point of time both in response to the "off" actuation of the same on/off switch. Thus an after cooling phase is provided after the shaver is switched off. During the after cooling phase the skin cooling element is further operated and therefore immediately ready (still cool not warm) in case the user switches the shaver on again. Thus also by interrupted on/off usage of the shaver the skin cooling element works properly and skin irritations are avoided.

According to one further aspect said microcontroller is adapted to immediately deactivate operation of said electromotor and relative to that to deactivate operation of said skin cooling element after lapse of a predetermined period of after cooling time both in response to the "off" actuation of the same on/off switch. This avoids making it dependent from actual measured temperature values. Thus no sensors are required. The predetermined period of time may be stored in the microcontroller. After lapse of the predetermined period of time the after cooling phase is finished and the skin cooling element is switched off by the microcontroller.

According to one further aspect said microcontroller is adapted to immediately deactivate operation of said electromotor and relative to that to deactivate operation of said skin cooling element after lapse of a predetermined period of at least 20 seconds and no more than 5 minutes both in response to the "off" actuation of the same on/off switch. This interval allows a lengthy usage pause while still providing a skin cooling element that is actually cool already after switch on of the shaver again.

According to one further aspect said microcontroller is adapted to immediately deactivate operation of said electromotor and relative to that to deactivate operation of said skin cooling element after lapse of a predetermined period of at least 40 seconds and no more than 3 minutes both in response to the "off" actuation of the same on/off switch. With this shorter after cool phase than that above the energy consumption by the skin cooling element is reduced.

According to one further aspect it is provided that in response to the "off" actuation of the on/off switch said microcontroller is adapted to operate the skin cooling element with reduced cooling effect after operation of the electromotor is deactivated and before the skin cooling element is deactivated. By this the energy consumption by the skin cooling element is reduced during the after cooling phase.

According to one further aspect the microcontroller operates the skin cooling element with full cooling effect during the electromotor is activated and allows shaving and wherein in response to the "off" actuation of the on/off switch said microcontroller is adapted to operate the skin cooling element with less than 50% of the full cooling effect after operation of the electromotor is deactivated and before the skin cooling element is deactivated. Alternatively the skin cooling element is operated to achieve about a constant temperature of the skin cooling element at the skin contact section.

According to one further aspect said microcontroller is adapted to operate said skin cooling element in accordance with a signal indicative for the temperature of the skin cooling element is received in response to an "off" actuation of the on/off switch. This may be a measured signal as measured by a sensor or another available electric value that correlates with the temperature of the skin cooling element.

According to one further aspect the skin cooling element comprises a thermoelectric element that is coupled with a passive cooling mass on a first side thereof and wherein said passive cooling mass is located adjacent the hair cutting element and provided with a free end skin contact section. Providing a passive mass like a free skin contact section allows proper buffering the cooled temperature and more stable cooling function of the skin cooling element.

According to one further aspect the skin cooling element comprises a thermoelectric element that is coupled with a heat sink on a second side thereof and wherein said heat sink being provided inside of the housing. The heat sink assures that the heat is distributed over a larger mass and thus increases less. The provision within the housing allows non warm handling of a shaver with skin cooling element.

According to one further aspect the microcontroller is adapted to cool the skin cooling element for a period of time that is based on at least one of: stored values of an empirical look-up-table and/or on the measured values of the Seebeck voltage at a thermocouple of the skin cooling element and/or the measured temperature of the passive cooling mass and/or the ambient temperature measured and/or the measured temperature of the heat sink.

According to one further aspect the microcontroller is adapted to cool the skin cooling element for said predetermined period of time after switch off of the shaver if the electromotor was operated for longer than 1 minute. E.g. the Seebeck voltage may be measured the peltier element and correlates with the it's temperature.

According to one further aspect a method for operating an electrically driven shaver is provided comprising at least one hair cutting element that is driven by an electromotor, a thermoelectric skin cooling element and said electromotor are electrically operable by a microcontroller and an on/off switch which is electrically connected with said microcontroller, wherein the skin cooling element is continued to be operated for cooling while the electromotor is deactivated by having activated the on/off switch into the "off" modus.

According to one further aspect of the method the skin cooling element is further operated to provide a cooling effect for a predetermined period of time after switch off of the shaver.

According to one further aspect an electrically driven shaver is used by switching off the shaver in order to stop operating at least one electrical driven hair cutting element and continuing to cool a thermoelectric skin cooling element during a after cooling phase.

In the following, a detailed description of several example embodiments will be given. It is noted that all features described in the present disclosure, whether they are disclosed in the previous description of more general embodiments or in the following description of example embodiments, even though they may be described in the context of a particular embodiment, are of course meant to be disclosed as individual features that can be combined with all other disclosed features as long as this would not contradict the gist and scope of the present disclosure. In particular, all features disclosed for either one of the or the method to produce such may also be applied to the other one, if applicable.

FIG. 1 shows a schematic cross sectional view of the shaver 1 with a housing 2. Within said housing 2 there are rechargeable batteries (not shown) driving an electromotor 3 if an on/off switch 4 is actuated by the user. The electromotor 3 is mechanically coupled with at least one hair cutting element 5, 6 and 7. As shown with FIG. 1 in this embodiment for example two short hair cutters 5 and 6 and at least one long hair cutter/trimmer 7 are provided. The short hair cutters could be of the longitudinal oscillatory translational type as shown with FIG. 1 in which an under cutter blade oscillates back and forth in a translational direction below an upper cutter foil or of the rotational type in which the cutting blades move in a rotational direction. The long hair cutter or trimmer(s) 7 are arranged side by side within the short hair cutters 5 and 6.

The shaver is equipped with a thermoelectric skin cooling element 8 which comprises a thermocouple or peltier element 9 which is coupled on one first side thereof with a free end skin contact section 10 and on the other second side thereof with a heat sink 11. Both the heat sink 11 and the free end skin contact section 10 are made of highly temperature conductive materials like e.g. Aluminum or other appropriate material. The free skin contact end section 10 is preferably bar or strip shaped and arranged side by side between one side of the long hair cutter 7 and one side of a short hair cutter 5. The free skin contact end section 10 may be arranged also at other locations relative to the hair cutting elements and may be stationary fixed or movable, e.g. spring loaded as well as the hair cutting elements. The free skin contact end section 10 may be integral with another part of the shaver or an extra part thereof. FIG. 1 shows the free skin contact end section 10 as an extra part. The free skin contact end section 10 is nothing more than a temperature conductive mass which is cooled by the action of the thermocouple 9. Thus the free skin contact end section 10 is a passive cooling element relative to the active cooling thermocouple 9. As usual with thermocouples or peltier elements 9 the non cooling side thereof is heating up at the same time. This heat is transported to another passive mass, i.e. the heat sink 11. The heat sink 11 may be constituted as an extra part or integral with another function of the shaver. With FIG. 1 the heat sink 11 is an extra part and allows receiving the heat to be distributed over a larger mass of material so that local temperatures at various points of the heat sink are still at an acceptable low level. The heat sink 11 is preferably but not necessarily provided within the housing 2.

By actuation of the same on/off switch 4 by the user both the electromotor 3 for driving the hair cutting elements 5, 6, and 7 and the thermocouple 9 are activated to operate via a microcontroller or microprocessor 12. The microcontroller 12 is electrically connected by connectors 13 and 14 with the electromotor 3 and the thermocouple to control and regulate its operation. There may be an extra switch (not shown) in addition or alternatively provided that allows individual actuation of the skin cooling element for activating or deactivating same.

The microcontroller 12 may be adapted to specifically regulate and control the switch off of the skin cooling element or the thermocouple or peltier element 9 to happen with a delay relative to the switch off of the shaver's electromotor 3. The delay time until the skin cooling element or the thermocouple or peltier element 9 actually completely switches off and discontinues to be operated after the switch off button 4 was actuated by a user may be at least 20 seconds or 40 seconds or 1 minute or a longer time up to 5 minutes. This delay time is preferably 1 minute (+/−20 seconds). It is preferably a predetermined value that is provided in a stored look up table within the microcontroller 12 and not dependent from a measured value that correlates directly or indirectly with the temperature of the free end skin contact section 10 or the first (cool) side of the peltier element 9.

The microcontroller 12 may in addition be adapted to specifically regulate and control the power and cooling effectiveness before the (complete) switch off of the skin cooling element or the thermocouple or peltier element 9 to happen. Thus the skin cooling element or the thermocouple or peltier element 9 may continue to operate at full level or at a reduced level during the above noted delay time interval before switch off. The reduced level of operation may be just as high to suffice for keeping the temperature stable at the first/cool side of the thermocouple 9 and avoid heating up by temperature transfer from the warm heat sink 11. The reduced level may be at least 10%, or 20% or 30% or 40% or 50% of the maximum or 100% cooling that is provided during shaving and before switch off of same. Thus in case the shaver is switched on again within the after cooling phase or delay time interval the free end skin contact section 10 is still feeling cool or at least not warm.

According to one aspect there is an additional extra switch provided for switch on and off of the skin cooling element. The microcontroller 12 may be adapted to check if the electromotor operated for less than a further predetermined period of time, which may be e.g. 1 minute (±30 seconds) at the time the skin cooling element is switched off either by a special switch for that or by the common on/off switch 4 for actuating the shaver operation. If this overall shaver operation was rather short it is assumed that the heat sink 11 has a low potential to warm up the free skin cooling section 11 after switch off and therefore the after cooling phase is kept short (e.g. 1 minute or less) or the skin cooling element is not further after cooled at all after switch off of same.

Figure 2:
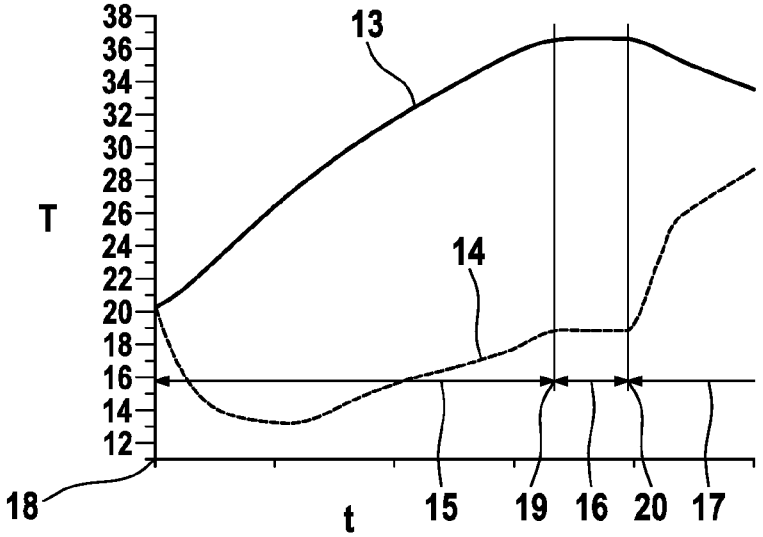

FIG. 2 shows an exemplary diagram of one way to operate the shaver, in which "t" stands for time and "T" for temperature. The heat sink temperature curve is shown by line 13 and the free end skin contact portion temperature curve is illustrated by the dotted line 14. At time 0 seconds which is time first point 18 both the shaver and the skin cooling element start operation. During the following first time interval 15 the shaver is driven, the free end skin contact section 10 is cooled and the temperature of the heat sink rises. At a second time point 19 the on/off switch 4 is actuated by a user and the shaver stops operation. In this following "after cooling phase" 16 the switch off of the skin cooling element is delayed and same is still operated at a reduced level such that the cooling compensates for the heating up by the warm heat sink 11 and the temperature of the skin cooling element is kept at a stable level. At a third time point 20 the after cooling phase is finished, it is assumed that the shaver will no longer be used within short and the skin cooling element is switched off which is triggered by the microcontroller 12. The following "complete off phase" 17 time interval shows that the temperatures of the heat sink and that of the free end skin contact section are balanced with each other so that the heat sink slowly cools down and the free end skin contact section warms up.

The values disclosed herein are not to be understood as being strictly limited to the exact numerical values recited. Instead, unless otherwise specified, each such value is intended to mean both the recited value and a functionally equivalent range surrounding that value. For example, a value disclosed as "50%" is intended to mean "about 50%+/−10%".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An electrically driven shaver, comprising a) a housing b) at least one hair cutting element attached to said housing, wherein said at least one hair cutting element that is driven by an electromotor contained within said housing, c) a thermoelectric skin cooling element attached to said housing;

d) a microcontroller, and e) a single on/off switch, wherein said on/off switch is connected to said microcontroller, wherein said microcontroller is electronically connected to said electromotor and said skin cooling element, wherein said skin cooling element is located adjacent to the hair cutting element, wherein actuating said single on/off switch into an off position deactivates the electromotor, wherein the skin cooling element is then deactivated by said actuation of said single on/off switch into said off position after a predetermined delay period after said single on/off switch is turned off.

2. The shaver according to claim 1, wherein said microcontroller is adapted to immediately deactivate operation of said electromotor.

3. The shaver according to claim 1, wherein said predetermined delay period of time is of at least 20 seconds and no more than 5 minutes.

4. The shaver according to claim 1, wherein said predetermined delay period of time is of at least 40 seconds and no more than 3 minutes.

5. The shaver according to claim 1, wherein in response to said actuation of said single on/off switch into said off position said microcontroller is adapted to operate the skin cooling element with reduced cooling effect after operation of the electromotor is deactivated and before the skin cooling element is deactivated.

6. The shaver according to claim 5, wherein the microcontroller operates the skin cooling element with full cooling effect during the electromotor is activated and allows shaving and wherein in response to said actuation of said single on/off switch into said off position, said microcontroller is adapted to operate the skin cooling element with less than 50% of the full cooling effect after operation of the electromotor is deactivated and before the skin cooling element is deactivated.

7. The shaver according to claim 1, wherein said microcontroller is adapted to operate said skin cooling element in accordance with a signal indicative for the temperature of the skin cooling element is received in response to said actuation of said single on/off switch into said off position.

8. The shaver according to claim 1, wherein the skin cooling element comprises a thermoelectric element that is coupled with a passive cooling mass on a first side thereof and wherein said passive cooling mass is located adjacent the hair cutting element and provided with a free end skin contact section.

9. The shaver according to claim 1, wherein the skin cooling element comprises a thermoelectric element that is coupled with a heat sink on a second side thereof and wherein said heat sink being provided inside of the housing.

10. The shaver according to claim 1, wherein the microcontroller is adapted to cool the skin cooling element for a period of time that is based on at least one of: stored values of an empirical look-up-table and/or on the measured values of the Seebeck voltage at a thermocouple of the skin cooling element and/or the measured temperature of the passive cooling mass and/or the ambient temperature measured and/or the measured temperature of the heat sink.

11. The shaver according to claim 1, wherein the microcontroller is adapted to actuate the skin cooling element for said predetermined delay period of time after said single on/off switch is turned off if the electromotor was operated for longer than 1 minute before the on/off switch is turned off.

* * * * *